United States Patent [19]

Chalmers

[11] 4,201,432

[45] May 6, 1980

[54] ELECTRIC CONNECTORS

[75] Inventor: Walter M. Chalmers, Dundee, Scotland

[73] Assignee: Ferranti Limited, Hollinwood, England

[21] Appl. No.: 952,078

[22] Filed: Oct. 17, 1978

[30] Foreign Application Priority Data

Oct. 28, 1977 [GB] United Kingdom ..... 45252/77

[51] Int. Cl.[2] ..... H01R 3/04

[52] U.S. Cl. ..... 339/14 R; 339/176 M; 339/182 R; 339/222

[58] Field of Search ..... 339/14, 17 L, 17 LC, 339/17 LM, 176 M, 182 R, 183, 184 M, 222

[56] References Cited

U.S. PATENT DOCUMENTS

| | | | |
|---|---|---|---|
| 3,202,954 | 8/1965 | Kinkaid | 339/17 LC |
| 4,116,516 | 9/1978 | Griffin | 339/17 F |

FOREIGN PATENT DOCUMENTS

| | | | |
|---|---|---|---|
| 88467 | 1/1967 | France | 339/176 MP |
| 1045759 | 10/1966 | United Kingdom | 339/176 M |

OTHER PUBLICATIONS

IBM-Shea; Double Contact Connector, Jul. 1966, vol. 9, No. 2, pp. 148, 149.

*Primary Examiner*—Joseph H. McGlynn
*Attorney, Agent, or Firm*—Kerkam, Stowell, Kondracki & Clarke

[57] ABSTRACT

An electric connector for interconnecting two printed circuit boards comprises a socket member for attachment to one board and a plug member for attachment to the other board. The socket member contains a number of rows of rigid contact members, while the corresponding contact members in the plug member are resilient. The resilient members are arranged so that they all deflect in the same direction when the plug is inserted into or removed from the socket.

4 Claims, 5 Drawing Figures

ELECTRIC CONNECTORS

This invention relates to electric connectors and particularly, though not exclusively, to two-part connectors for interconnecting printed circuit boards.

Many types of electric connectors are known, and some of these are intended for interconnecting printed circuit boards. Usually these latter connectors comprise a conventional edge connector mounted on, and electrically connected to, one board and arranged to receive an edge of another board. In such edge connectors the resilient contacts are usually arranged in two parallel rows so that the contacts in one row move away from those in the other row as the edge of a board is inserted into the connector.

Frequently the tracks on the printed circuit board carry high frequency or digital signals, and problems of distortion and crosstalk may arise. Digital signals are usually in the form of pulses with very short rise times, and distortion may lead to further problems.

It is an object of the invention to provide an electric connector in which the above problems are reduced.

According to the present invention there is provided an electrical connector which includes a socket member comprising an insulating housing in which are located a plurality of rigid conductive contact members arranged in a number of aparallel rows separated from but overlapping one another, and a plug member comprising an insulating body member in which are located a plurality of resilient conductive contact members arranged in a number of parallel rows so as to co-operate with the rigid contact members carried by the socket member, the resilient contact members being so arranged that they all deflect in the same direction on insertion or removal of the plug member into or from the socket member.

One row of rigid contact members may be in the form of a single continuous contact member extending over the full length of the row.

Preferably the plug member and the socket member each carry three rows of contact members, the centre row of contact members in the socket member comprising a single continuous member.

The invention will now be described with reference to the accompanying drawings, in which.

Figure 1:
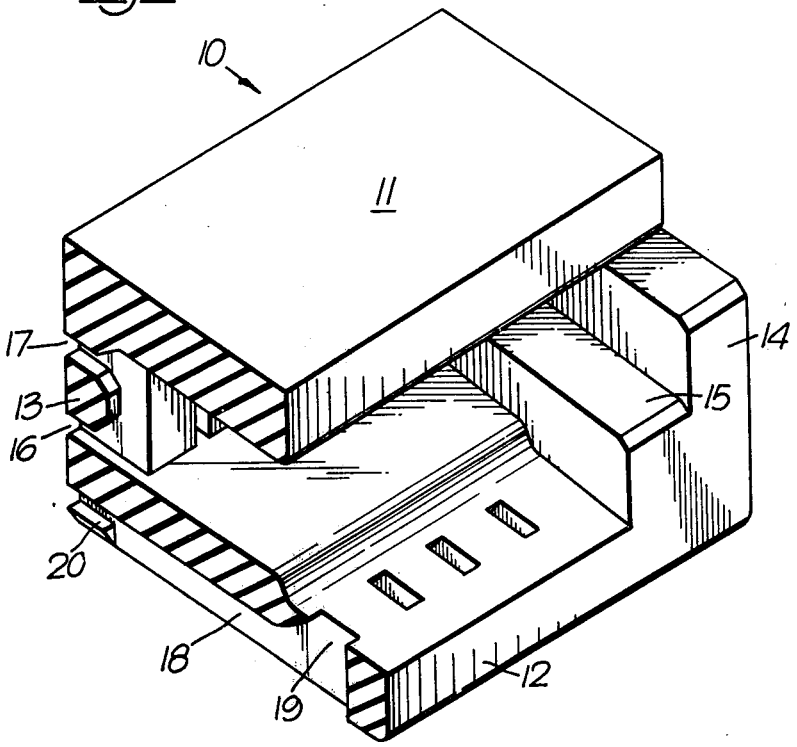
FIG. 1 is a sectional perspective view of the housing of a socket member.
Figure 2:
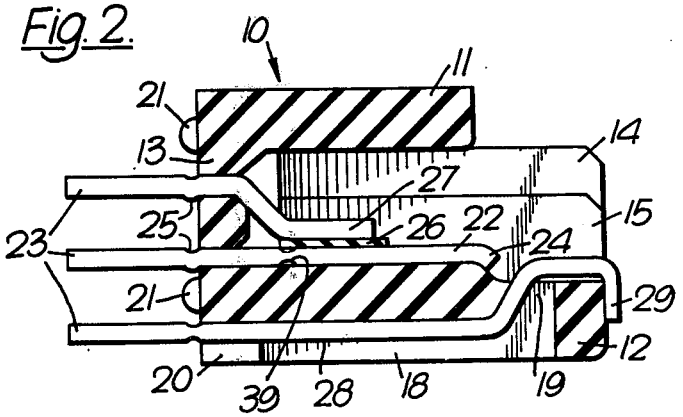
FIG. 2 is a sectional view of a socket member.

Referring now to FIGS. 1 and 2, the socket member comprises an elongated housing 10 of insulating material having a generally rectangular cross-section. The two sides of the moulding, hereafter referred to as the "top" wall 11 and the "bottom" wall 12, project from the interconnecting base 13 of the housing to different extents, the top wall 11 being shorter.

At the two ends of the housing, only one of which is shown in FIG. 1, is an end wall 14, which is formed with a ledge 15. The bottom wall 12 is thinner at its outer end than at its inner and as shown, the inner surface being stepped outwards.

At equally spaced intervals along the length of the housing, two rows of apertures 16 and 17 are formed through the base 13 into the space between the walls 11 and 12. The apertures of row 16 are in line with the inner surface of the bottom wall 12, whilst the apertures of row 7 are approximately in line with the inner surface of the top wall 11. In addition, a similarly-spaced row of slots 18 are formed in the outer surface of the bottom wall 12. These slots 18 break through the thinner part of wall 12 to form a series of apertures 19. Resilient projections 20 extend into each slot 18 near to the base 13 of the housing. Projections 21, shown in FIG. 2, are formed at intervals on the outer surface of the base 13.

FIG. 2 shows also the contacts used with the housing to form a socket member. In the example shown three different shapes of contacts are used. All are formed from relatively rigid electrically-conducting material, and the contact surfaces may be gold-plated.

The contacts 22 which pass through the row of apertures 16 in the base of the housing are almost straight, having a terminal post 23 at one end and a slight hook 24 at the opposite end. As shown in FIG. 2, these contact members must be inserted between the walls 12 so that the crimp 25 passes through the aperture 16 and the hook lies over the edge of the slope in the inner surface of the bottom wall 12. The crimp 39 prevents the contact 22 from passing through the aperture 16.

A thin strip of insulating material 26 is placed over the inner part of the contacts 22 and is held in place by the upper row of contact 27 which are bent towards contacts 22. These are inserted in a similar manner to the contacts 22.

The third set of contacts 28 are formed with a hook 29 at one end. These contacts are inserted by passing the hook 29 through the aperture 19 in the bottom wall, and then pressing the contact into the slot 18 in the bottom wall. The contact is retained in the slot by the projections 20. The contacts 27 and 28 are provided with terminal posts 23 of the same form as those on contacts 22.

Figure 3:
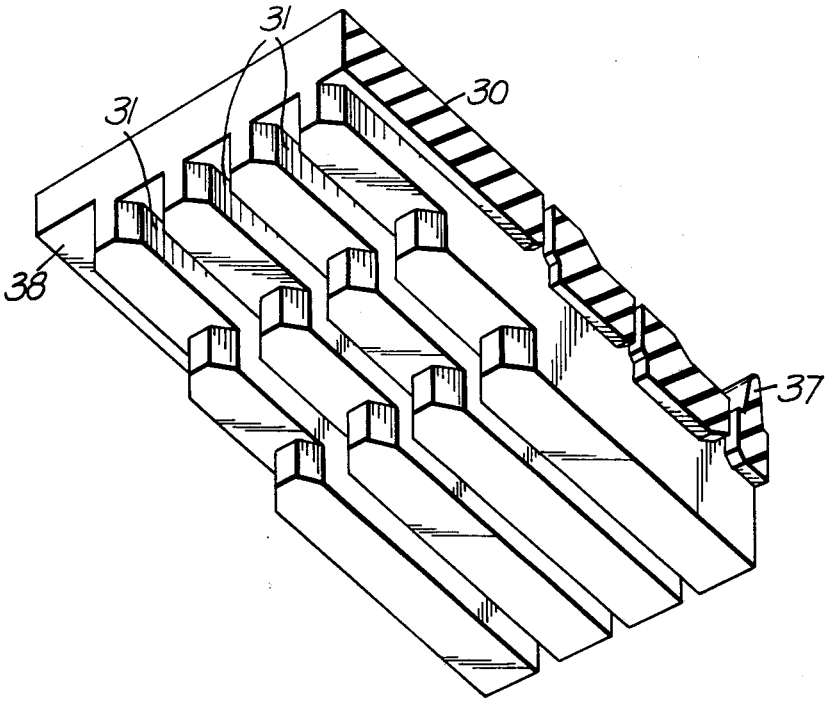
FIG. 3 is a sectional perspective view of the body of a plug member.
Figure 4:
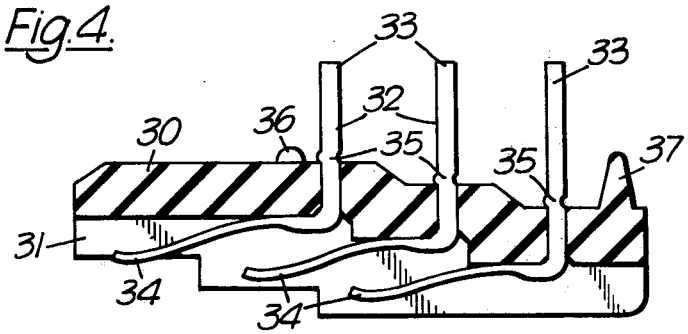
FIG. 4 is a sectional view of a plug member.

FIGS. 3 and 4 show views of the co-operating plug member. An insulating body member 30 is of stepped form, having a series of grooves 31 formed in it, these grooves also being stepped. Each groove 31 contains three contact members 32 of similar shape as shown in FIG. 4. Each contact member comprises a rigid terminal post 33 and, approximately at right-angles to the post, a resilient contact arm 34. The contacts are inserted into the grooves by passing the terminal posts 33 through holes in the body so that the three contacts in each groove overlap as shown in FIG. 4. The contacts are retained in position by crimped portions 35 on each terminal post. Those parts of the body separating the grooves 31 act as insulation between adjacent contacts in a row.

A number of projections 36 are formed along the body, together with a projecting ridge 37. At each side of the body member is a projecting ledge 38, arranged to co-operate with the corresponding ledge 15 on the socket member.

Figure 5:
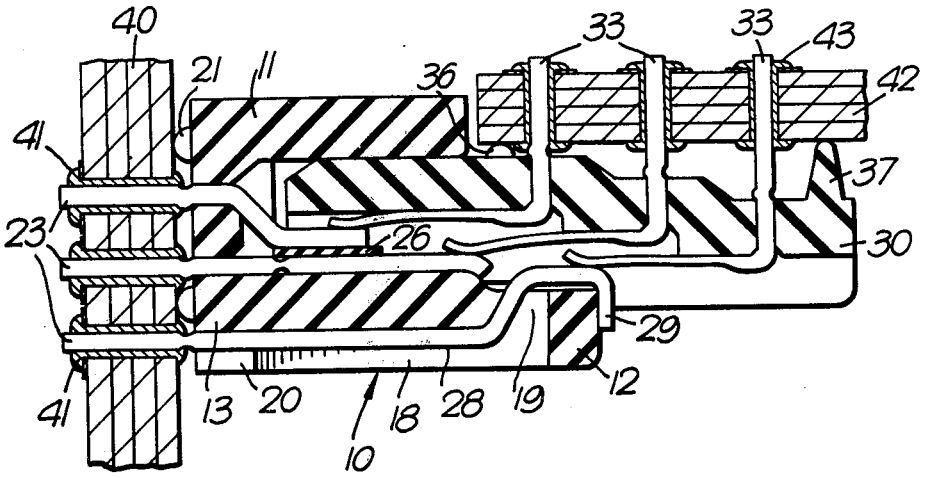
FIG. 5 is a sectional view showing a plug member inserted into a socket member.

FIG. 5 illustrates one possible application of the plug and socket members described above.

The socket member 10 is attached to a multi-layer printed circuit board 40 by soldering the terminal posts 23 of the contact members into plated-through holes 41 in the circuit board. This enables each terminal post to be connected to a different conducting track on the board 40. The socket member is spaced from the board by the projections 21 formed on the base of the socket member.

The plug member 30 is similarly attached to a printed circuit board 42, with the terminal posts 33 of the contact members soldered into plated-through holes 43. The board 42 is spaced from the plug member by the projections 36 and ridge 37 formed on the plug member.

The plug member 30 may then be inserted into the socket member 10 by engaging the co-operating ledges 15 and 38 on the two members. The action of sliding the plug member into the socket member causes the resilient contact arms 34 of the plug member to deflect upwards as they engage with their respective rigid contacts in the socket member. The contact arms all move in the same direction and the distance between them remains approximately constant.

The action of separating the two members is the opposite of that described above.

The embodiment described above has three rows of contact members in each part of the connector. This is particularly useful when the tracks on the printed circuit boards carry high-speed or high-frequency signals, since the centre row of contacts may be connected to one or more earth planes. This enables the connector to interconnect transmission lines in the two boards, and also provides screening between adjacent contacts. If all the contacts in the centre row are connected to a common earth plane, then the separate contact members in the centre row of the socket member may be replaced by a single elongated contact member having a plurality of terminal posts.

The connector may, of course, be used with only two rows of contact members, or with more than three rows. In the latter case any row or rows may be used to connect to an earth plane.

The connector need not be used with printed circuit boards. Individual conductors or cables may be connected to the terminal posts of the plug and socket members as required.

Although the contact arrangement is not such as to provide perfect impedance matching between conductors connected to the plug and socket members, the matching provided is better than that given by the conventional edge-connector. This is due to the fact that the spacing between the resilient contact arms in the rows of the plug member remains substantially constant. The spacing between the rows of contacts may also be made smaller than is possible with a conventional edge connector, thus enabling a wider range of characteristic impedance to be accommodated.

What I claim is:

1. An electrical connector comprising a socket member, an insulating housing for the socket member in which are located a plurality of rigid conductive contact members arranged in a number of parallel rows separated from but overlapping one another, one row of contact members being provided by a single continuous contact member extending over the full length of the row, and a plug member comprising an insulating body member in which are located a plurality of resilient conductive contact members arranged in a number of parallel rows so as to cooperate with the rigid contact members carried by the socket members, the resilient contact members being so arranged that they all deflect in the same direction on insertion or removal of the plug member into or from the socket member.

2. A connector as claimed in claim 1 in which the socket member has three rows of contact members, the center row being a single continuous contact member.

3. A connector as claimed in claim 1 or claim 2 in which the contact members have terminal posts for connection with the conductors of an electric circuit.

4. A connector as claimed in claim 3 in which the terminal posts are arranged for connection to the conductors of a printed circuit board.

* * * * *